US006378182B1

(12) United States Patent
Mamayek et al.

(10) Patent No.: US 6,378,182 B1
(45) Date of Patent: Apr. 30, 2002

(54) METHOD OF APPLYING A MATCHING LAYER TO A TRANSDUCER

(75) Inventors: Don S. Mamayek, Mountain View; Veijo Suorsa, Sunnyvale, both of CA (US)

(73) Assignee: Scimed Line Systems, Inc., Maple Grove, MN (US)

( * ) Notice: Subject to any disclaimer, the term of this patent is extended or adjusted under 35 U.S.C. 154(b) by 0 days.

(21) Appl. No.: 09/525,079

(22) Filed: Mar. 14, 2000

Related U.S. Application Data

(63) Continuation of application No. 09/071,695, filed on May 1, 1998.

(51) Int. Cl.[7] ..... H04R 17/00
(52) U.S. Cl. ..... 29/25.35; 29/594
(58) Field of Search ..... 29/620, 846, 848, 29/25.35, 594; 101/128.2, 128.3, 128.4, 129; 427/58, 96, 102, 282, 265; 118/504, 505

(56) References Cited

U.S. PATENT DOCUMENTS

| | | | | | |
|---|---|---|---|---|---|
| 3,247,573 | A | * | 4/1966 | Noack | 29/155.5 |
| 4,084,506 | A | * | 4/1978 | Natatani | 101/127 |
| 4,242,401 | A | * | 12/1980 | Mitani | 428/201 |
| 4,311,267 | A | | 1/1982 | Lim | 228/180 |
| 4,581,098 | A | | 4/1986 | Gregor | 156/635 |
| 4,656,048 | A | | 4/1987 | Kudoh et al. | 427/8 |
| 4,919,969 | A | | 4/1990 | Walker | 427/58 |
| 5,173,457 | A | | 12/1992 | Shorthouse | 501/65 |
| 5,491,871 | A | * | 2/1996 | Reber | 15/308 |
| 5,537,908 | A | | 7/1996 | Rabe et al. | 84/454 |
| 5,660,632 | A | | 8/1997 | Volpe, Jr. et al. | 118/213 |
| 5,701,816 | A | * | 12/1997 | Fujiwara | 101/128.4 |
| 5,762,259 | A | | 6/1998 | Hubacher et al. | 228/180.22 |

FOREIGN PATENT DOCUMENTS

| | | |
|---|---|---|
| JP | 60191600 | 9/1985 |

* cited by examiner

*Primary Examiner*—Lee Young
*Assistant Examiner*—Sean Smith
(74) *Attorney, Agent, or Firm*—Lyon & Lyon LLP

(57) ABSTRACT

A method of applying a matching layer to a transducer includes placing the transducer on a fixture and covering the transducer with a stencil so that an opening in the stencil allows access to a metal-coated, piezoelectric surface of the transducer, and so that the stencil is affixed to the transducer surface. A roughly cylindrically shaped bead of epoxy is extruded onto the stencil at a predetermined distance from the opening, and a blade is positioned upstanding relative to the transducer surface and located so that the bead lies between the blade and the opening. The fixture is moved laterally so that the blade rolls the bead across the exposed transducer surface to form a layer of epoxy thereon. The fixture can then be moved back in the opposite direction to its initial position if desired. The assembly can also be subjected to a vacuum before the fixture is returned to its initial position. If desired, the fixture can be designed to vibrate during movement. Also if desired, the epoxy bead can initially be placed in a trough designed to decrease surface-area exposure to the air. Alternatively, the fixture can be kept stationary while the blade is moved.

5 Claims, 2 Drawing Sheets

METHOD OF APPLYING A MATCHING LAYER TO A TRANSDUCER

This Application is a continuation of U.S. application Ser. No. 09/071,695 filed May 1, 1998, which is incorporated by reference as if set forth fully herein.

BACKGROUND OF THE INVENTION

1. Field of the Invention

The present invention pertains to the field of transducers, and more particularly to methods of applying a matching layer to a transducer.

2. Background

Piezoelectric transducers find a wide variety of application in ultrasonic and electroacoustic technologies. Characterized by the presence of a shaped, piezoelectric material such as, for example, lead zirconate titanate (PZT), these devices convert electric signals to ultrasonic waves, and generally vice versa, by means of the piezoelectric effect in solids. This effect is well known in the art of transducers and their manufacture. A piezoelectric material is one that exhibits an electric charge under the application of stress. If a closed circuit is attached to electrodes on the surface of such a material, a charge flow proportional to the stress is observed. A transducer includes a piezoelectric element, and if necessary, an acoustic impedance matching layer and an acoustically absorbing backing layer.

Transducers can be manufactured according to conventional methods. Thus, a thin piezoelectric substrate is metalized on its two surfaces with a coating such as, for example, gold plating. The thickness of the piezoelectric element is a function of the frequency of sound waves. One surface of the piezoelectric element can be coated with an acoustic impedance matching layer, or multiple matching layers, as desired. A backing layer is attached to the backside of the piezoelectric element. The backing layer material is typically cast in place via a mold such that the piezoelectric element lies between the matching layer and the backing material. The matching layer, which may be formed of an electrically conductive material, serves to couple between the acoustic impedances of the piezoelectric element and the material targeted by (i.e., at the front of) the transducer. Individual piezoelectric transducers are made from the piezoelectric-material/matching material-layer. A preferred backing material and method of applying the backing material to a transducer are disclosed and described in related U.S. patent application Ser. No. 09/171,747, entitled Transducer Backing Material And Method Of Application, filed on the same day as the present application and fully incorporated herein by reference.

The method of applying the matching layer must be tailored to result in a precise thickness and acoustic impedance for the matching layer in order to match as closely as possible the acoustic impedance of the piezoelectric material to the acoustic impedance of the medium to which the piezoelectric material is ultrasonically coupled. Conventionally, the matching layer has been applied from above to a surface of the gold-coated, or gold-over-nickel-coated, piezoelectric material. A cylindrically shaped bead of epoxy was positioned at an edge of the surface and then "rolled" on with the aid of a stencil and a doctor blade to form a "smoothed-on-" matching layer.

However, a problem with the conventional method is that the outer layer forms a "skin" during a preparation before the bead is "rolled," and the skin portion does not stick properly to the piezoelectric material. This results in a "skin effect," i.e., patches on the piezoelectric surface where the matching layer has not adhered. Additionally, such a method often causes air bubbles to become trapped in the matching layer as the epoxy cured. This results in inefficient transducers because the air bubbles reflect ultrasonic waves propagating through them to a degree sufficient to significantly degrade the impedance match.

To reduce the formation of air bubbles, the matching layer has been applied in a vacuum chamber. However, the vacuum tends to increase the skin effect and misshape the bead of epoxy, necessitating that a substantial portion of the bead be discarded during the application process. Hence, the transducer manufacturing process was rendered more costly and less efficient. Moreover, small air bubbles still remained regardless of the vacuum, having been caused by extrusion of the bead from the syringe. Thus, there is a need for an application method that minimizes skin effect and air-bubble formation in the matching layer without increasing the manufacturing cost of the transducer.

SUMMARY OF THE INVENTION

The present invention is directed to an application method that minimizes skin effect and air-bubble formation in the matching layer without increasing the manufacturing cost of the transducer. To these ends a method of applying a matching layer to a transducer includes positioning a stencil adjacent a transducer so that a surface of the transducer is accessible through an opening of the stencil and the stencil is affixed to the transducer surface. A bead of matching-layer material is deposited on the stencil at a predetermined distance from the opening, and a blade is placed next to the bead so that an edge of the blade contacts the stencil and the bead lies between the blade and the opening. Relative sliding motion is then initiated between the transducer surface and the edge of the blade.

In a first, separate aspect of the invention, the bead can be placed a sufficient distance from the opening to allow an outer layer of the bead to be deposited on the stencil during the sliding motion of the transducer surface relative to the edge of the blade. Advantageously, the bead can be placed in a trough designed to decrease the proportion of bead-surface-area exposure to the air.

In a second, separate aspect of the invention, the relative sliding motion can be initiated in a first direction and then reversed to return the transducer surface and the edge of the blade to their initial relative positions. Preferably, the transducer is placed on a movable fixture and the blade is maintained in a stationary position. Most desirably, the movable fixture can be designed to vibrate while moving laterally relative to the edge of the blade.

In a third, separate aspect of the invention, the relative sliding motion can be initiated in a first direction, then the assembly can be subjected to a vacuum and the relative sliding motion can be reinitiated in a reverse direction to return the transducer surface and the edge of the blade to their initial relative positions.

Accordingly, it is an object of the present invention to provide a method of applying a matching layer to a transducer that increase the efficiency of the transducer without increasing the cost to produce the transducer. These and other objects, features, aspects, and advantages of the present invention will become better understood with reference to the following description and accompanying drawings.

DETAILED DESCRIPTION OF THE PREFERRED EMBODIMENT

Figure 1:
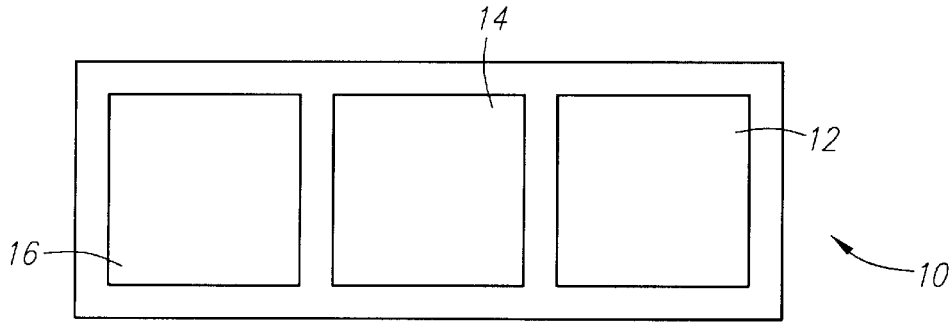
FIG. 1 is a plan view of a transducer slice.
Figure 2:
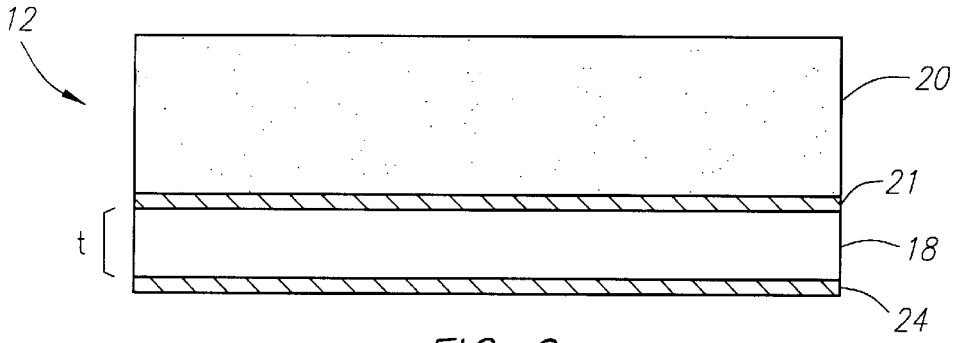
FIG. 2 is an end view of a wafer cut from the transducer slice of FIG. 1.

As illustrated in FIG. 1, a slice of transducer material 10 is preferably cut to yield three wafers 12, 14, 16. In a preferred embodiment, a typical wafer 12 measures 0.75 inches on each side. In an alternate preferred embodiment, the wafer 12 can be cut to measure one square inch or larger. As shown in FIG. 2, the transducer wafer 12 includes a piezoelectric substrate 18 and a matching layer 20. The matching layer 20 is adhered to the piezoelectric substrate 18, which is made of lead zirconate titanate, or PZT, in a preferred embodiment. The matching layer 20 is preferably electrically conductive, but could likewise be made of nonconductive material. The piezoelectric layer 18 is preferably metallized on both surfaces with a coating 21, 24 of gold, gold-over-nickel. In a preferred embodiment, the piezoelectric layer 18 has a thickness t of about 0.0027 inches.

Figure 3:
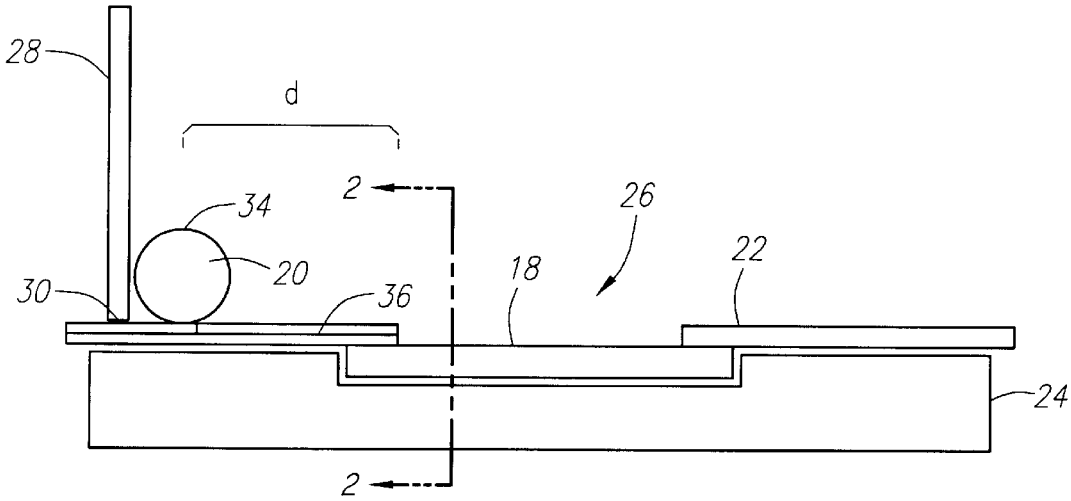
FIG. 3 is a cross-sectional side view of an apparatus used to apply a matching layer to the transducer wafer of FIG. 2.
Figure 4:
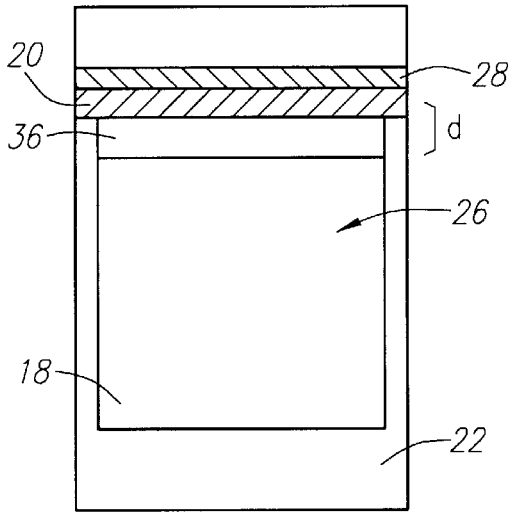
FIG. 4 is a plan view of the apparatus of FIG. 3.
Figure 5:
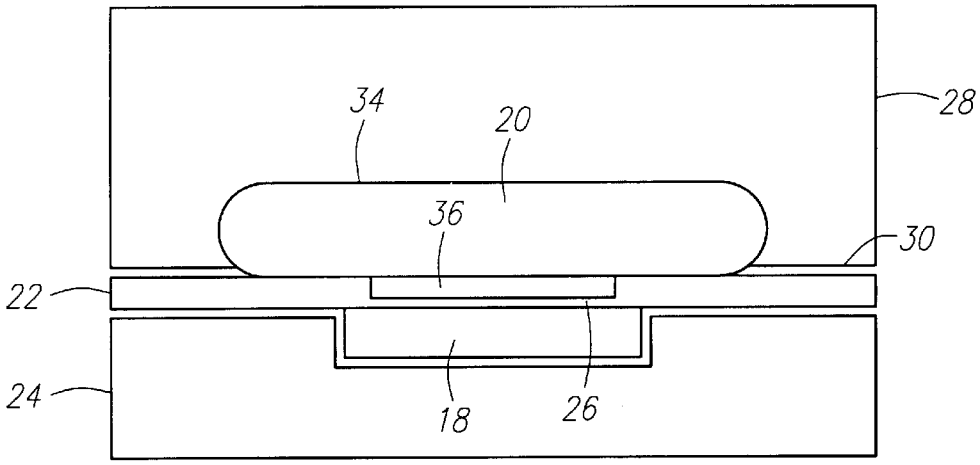
FIG. 5 is a cross-sectional view taken across lines A—A in FIG. 3.

In a preferred embodiment, the matching layer 20 is applied to the piezoelectric transducer substrate 18 as depicted in FIGS. 3–5. Thus, the coated, piezoelectric substrate 18 is placed underneath a stencil 22 upon a fixture 24. The stencil 22 includes an opening 26 that exposes a substantial part of the surface of the piezoelectric substrate 18. A bead of matching-layer material 20, preferably epoxy, is deposited upon the stencil 22, displaced laterally from the opening 26 by a predetermined distance d. The bead 20 is roughly cylindrical in shape, and in a preferred embodiment, is extruded from a syringe. A blade 28 commonly referred to as a doctor blade 28 is positioned roughly vertically with respect to the horizontal plane of the surface of the piezoelectric substrate 18 such that an edge 30 of the doctor blade 28 contacts the stencil 22. The doctor blade 28 is situated adjacent a first side of the bead 20 of epoxy, with the opening 26 of the stencil 22 being located opposite a second side of the epoxy bead 20, such that the bead 20 lies between the doctor blade 28 and the opening 26. A recessed area 36 of stencil 22 is used to collect skin material ("skin") 34 as the epoxy bead 20 is rolled over the stencil 22. The thickness of the stencil 22 is used to establish the thickness of the matching layer, which varies with the medium in which the transducer will be designed to operate. In a preferred embodiment, the stencil 22 has a thickness of 0.005 inches, or 5 mils. The stencil may also advantageously have a thickness of 10 mils or more. Additionally, the recessed area 36 preferably has a depth of 0.002 inches, giving the stencil 22 a thickness of 0.003 inches under the recessed area 36. The skin 34 collected in the recessed area 36 is disposed of when cleaning the stencil 22.

In a preferred embodiment, the fixture 24 is moved laterally (i.e., horizontally) with respect to the vertically oriented doctor blade 28. The stencil 22 and piezoelectric layer 18 move with the fixture 24. The doctor blade 28 is maintained in a fixed, or stationary, position. The relative motion causes the bead 20 to be rolled across the stencil 22 so that a layer is deposited, or "smoothed," across the surface of the piezoelectric material 18. In an alternative embodiment, the fixture is maintained steadfast while the doctor blade 28 is moved laterally. The predetermined distance d may likewise be varied, but is preferably a distance sufficient to allow the part of the outer layer, or "skin," of the epoxy bead 20 that is exposed to air between the doctor blade 28 and the stencil 22 to be deposited on the stencil 22, and not on the surface of the piezoelectric material 18. In a preferred embodiment, the distance d is approximately one-half of one inch in length.

In an especially preferred embodiment, the fixture 24 is designed to move in either direction horizontally. Thus, the bead 20 is deposited on the stencil 22 proximate the doctor blade 28. The fixture 24 is then moved horizontally until a layer of epoxy 20 is deposited across the surface of the piezoelectric substrate 18. The entire assembly is subsequently subjected to a vacuum. Then, under vacuum, the fixture 24 is moved back in the opposite direction, returning the opening 26 and the edge 30 of the doctor blade 28 to their initial relative positions. The assembly is then returned to normal, ambient air pressure. The combination of a first pass under ordinary conditions followed by a second pass in a vacuum minimizes air-bubble formation within the matching layer 20 without miss-shaping the bead 20 prior to its application to the piezoelectric layer 18. Thus, transducer efficiency is enhanced without raising the manufacturing cost.

Figure 6:
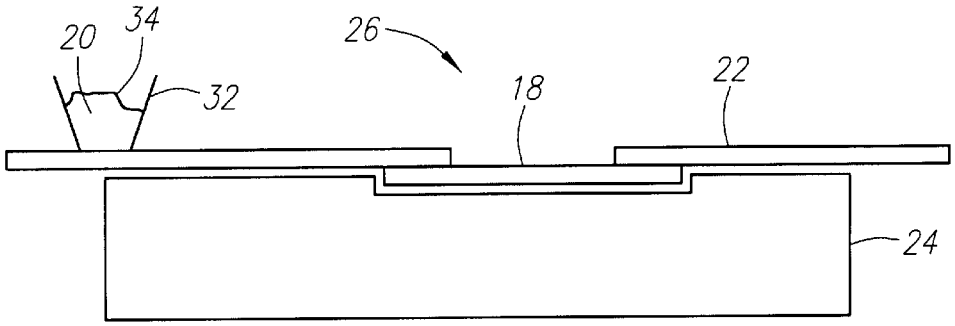
FIG. 6 is a cross-sectional side view of an alternative apparatus used to apply a matching layer to the transducer wafer of FIG. 2.

In an alternative embodiment, a trough 32 may be used to hold the bead 20 prior to application, as shown in FIG. 6. The trough 32 decreases the amount of exposed material to skin 34 on the bead 20 prior to application. In another alternative embodiment, a vibrating sled can be substituted for the fixture 24. The agitation of the vibrating sled 24 serves to counteract the formation of air bubbles within the matching layer 20.

After application of the matching-layer material 20 to the piezoelectric layer 18, the matching-layer material 20 is cured and then the matching-layer thickness is reduced to the optimum thickness for the operating frequency of the transducer.

Only preferred embodiments have been shown and described, yet it will be apparent to one of ordinary skill in the art that numerous alterations may be made without departing from the spirit or scope of the invention. Therefore, the invention is not to be limited except in accordance with the following claims.

What is claimed is:

1. A method of applying a matching layer to a transducer, comprising the steps of:

fixing a stencil to the transducer so that a surface of the transducer is accessible through an opening of the stencil;

placing a bead of matching layer material on the stencil at a predetermined distance from the stencil opening;

situating a blade adjacent the bead such that an edge of the blade contacts the stencil and the bead lies between the blade and the opening;

initiating relative sliding motion, under atmospheric conditions, in a first direction between the transducer surface and the edge of the blade; and initiating relative sliding motion, under vacuum conditions, in a second direction between the transducer surface and the edge of the blade, wherein the second direction is opposite to the first direction.

2. A method according to claim 1, wherein the bead of matching layer material is placed in a recess in the stencil that is adjacent to the opening.

3. A method of applying a matching layer to a transducer, comprising the steps of:

fixing a stencil to the transducer so that a surface of the transducer is accessible through an opening of the stencil;

placing a trough on the stencil at a predetermined distance from the stencil opening, the trough including a bead of matching layer material therein, the trough reducing the exposed surface area of the bead;

situating a blade adjacent the bead such that an edge of the blade contacts the stencil and the bead lies between the blade and the opening;

initiating relative sliding motion in a first direction between the transducer surface and the edge of the blade; and initiating relative sliding motion in a second direction between the transducer surface and the edge of the blade, wherein the second direction is opposite to the first direction.

4. A method according to claim 3, wherein the step of initiating relative sliding motion in the first direction is performed under atmospheric conditions.

5. A method according to claim 3, wherein the step of initiating relative sliding motion in the second direction is performed under vacuum conditions.

* * * * *